US005333328A

United States Patent [19]

Roberts

[11] Patent Number: 5,333,328

[45] Date of Patent: Aug. 2, 1994

[54] ADJUSTABLE VISOR APPARATUS FOR BICYCLE HELMET

[76] Inventor: Samuel E. Roberts, 422 North Loquat Ave., Tucson, Ariz. 85710

[21] Appl. No.: 14,873

[22] Filed: Feb. 5, 1993

[51] Int. Cl.[5] ..... A42B 1/24

[52] U.S. Cl. ..... 2/422; 2/425; 2/12

[58] Field of Search ..... 2/12, 13, 422, 425, 2/424, 15, 10, 209.12, 195.1, 195.2, 195.3, 195.4, 195.7

[56] References Cited

U.S. PATENT DOCUMENTS

| | | | |
|---|---|---|---|
| 2,968,812 | 1/1961 | Vivolo | 2/12 |
| 3,239,842 | 3/1966 | Marchello | 2/422 |
| 4,096,589 | 6/1978 | Goldstein | 2/12 |
| 4,575,875 | 3/1986 | Dawson et al. | 2/422 |
| 4,630,317 | 12/1986 | Brown et al. | 2/12 |
| 5,070,545 | 12/1991 | Tapia | 2/12 |

FOREIGN PATENT DOCUMENTS

| | | | |
|---|---|---|---|
| 2508777 | 1/1983 | France | 2/422 |

*Primary Examiner*—Clifford D. Crowder
*Assistant Examiner*—Michael A. Neas
*Attorney, Agent, or Firm*—H. Gordon Shields

[57] ABSTRACT

Bicycle helmet apparatus includes a visor which is removable and adjustable relative to the visor. The helmet includes three patches of fastening material and the visor includes three patches of mating material. The visor is preferably secured to the helmet at the three locations and may be pivoted or oriented relative to the visor by varying the locations at which the patches on the visor are connected to the fixed patches on the helmet. The visor is completely removable from the helmet, if desired.

4 Claims, 1 Drawing Sheet

FIG. 1
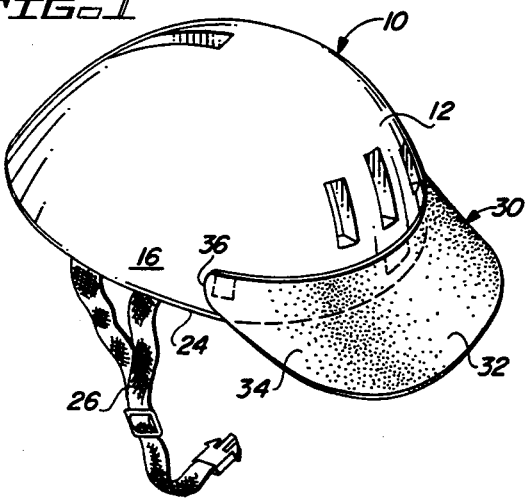
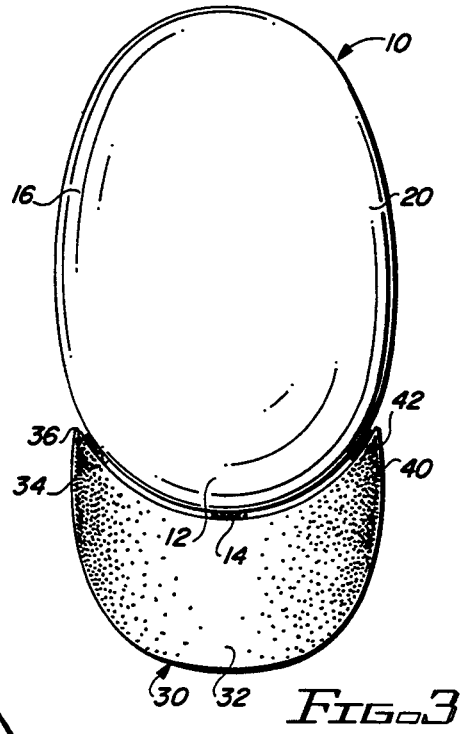
FIG. 3
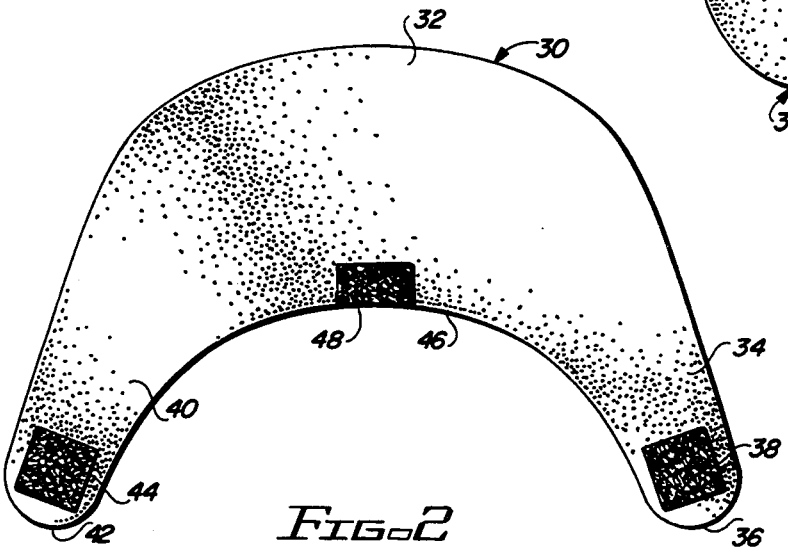
FIG. 2
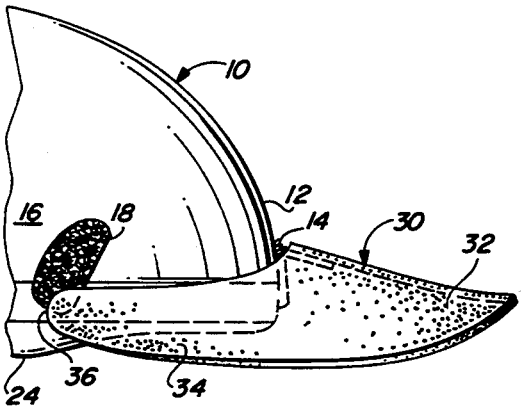
FIG. 4
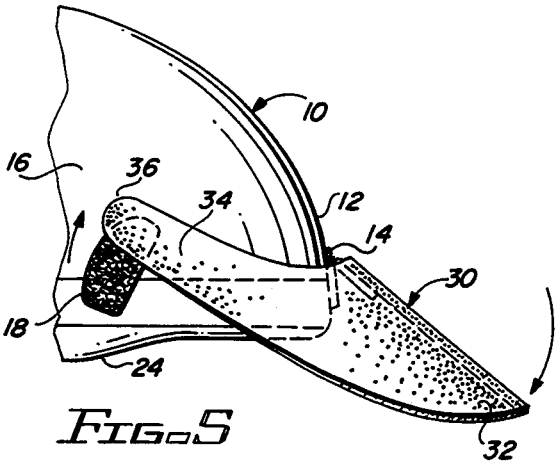
FIG. 5

ADJUSTABLE VISOR APPARATUS FOR BICYCLE HELMET

BACKGROUND OF THE INVENTION

1. Field of the Invention

This invention relates to bicycle helmets and, more particularly, to a visor for a bicycle helmet and the visor may be adjustable for the convenience of the wearer or user of the helmet and in response to changing bicycling conditions, such as the location of the sun or rain relative to the helmet and to the user thereof.

2. Description of the Prior Art

Typically, bicycle helmets do not have visors. Rather, the bicycle helmets are simply protective shells, the purpose of which is to protect the head of the wearer or user in the event of an accident, such as a fall from the bicycle. Since riders differ in their relationship to the bicycle and to the surrounding environment, it is difficult to provide a built-in visor for a helmet that will be adaptable or convenient, or even safe, for a variety of bicycle riders. Since bicycle riders are not in a vertical orientation, such as are motorcycle riders, the visors, such as found on some helmets of motorcycle riders, are not adaptable to the helmets of the bicycle riders.

However, it is obvious that bicycle riders need protection from the sun as they ride into the sun. The apparatus of the present invention provides a visor for a bicycle helmet in which the user of the visor and helmet may adjust the visor to suit the particular needs and circumstances of the user. The user may also adjust the visor for the personal preference of the rider or user. For example, a rider or user who rides with the head down may adjust the visor higher than the visor would be for a rider who rides with the head higher.

SUMMARY OF THE INVENTION

The invention described and claimed herein comprises a relatively flexible visor which may be connected to a bicycle helmet in the plurality of orientations through a three suspension point fastening system. The visor may be appropriately oriented relative to the helmet and to the user through a simple pivoting movement by changing the fastening arrangement of the visor relative to the helmet. The helmet includes three patches which are relatively large, and the visor similarly includes three patches which matingly engage the fixed patches on the helmet. The patches on the visor allow the visor to be pivoted relative to the helmet and accordingly the orientation of the visor may be changed to any desirable orientation. In the alternative, the visor may be removed entirely from the helmet.

Among the objects of the present invention are the following:

To provide new and useful bicycle helmet apparatus;

To provide new and useful visor apparatus for a bicycle helmet;

To provide new and useful adjustable visor apparatus for a bicycle helmet;

To provide new and useful visor securable to a bicycle helmet at three locations; and To provide new and useful bicycle helmet apparatus having a removable and adjustable visor.

BRIEF DESCRIPTION OF THE DRAWING

FIG. 1 is a perspective view of helmet apparatus including the present invention.

FIG. 2 is a bottom plan view of the visor portion of the apparatus of the present invention.

FIG. 3 is a top view of the apparatus of FIG. 1 showing the visor secured to the helmet.

FIG. 4 is a side view illustrating the securing of the visor to the helmet in one particular orientation.

FIG. 5 is a side view of the apparatus of the present invention showing the visor tilted or adjustable relative to the helmet.

DESCRIPTION OF THE PREFERRED EMBODIMENT

FIG. 1 is a perspective view of helmet apparatus 10 with a visor 30 secured thereto. The helmet 10 is typically a bicycle rider's helmet and is accordingly configured.

FIG. 2 is a bottom plan view of the visor 30, illustrating its configuration and the elements associated with the visor 30 for securing the visor to the helmet 10. FIG. 3 is a top plan view of the helmet 10 with the visor 30 secured to the helmet.

FIGS. 4 and 5 are side views showing a portion of the helmet 10 with the visor 30 in different orientations. For the following discussion, reference will be made to all five of the Figures in the drawing.

The helmet 10, insofar as the apparatus of the present invention is concerned, includes a front portion 12, a right side portion 16, a left side portion 20, and a bottom rim 24. A fastening strap 26 is shown secured to and extending downwardly from the bottom rim 24 at the right side 16 of the helmet 10. The helmet 10 has a second strap portion which is secured to and extends downwardly from the bottom rim 24 on the left side 20. The second strap portion is not shown in the Figures.

The visor 30 includes a front, main shade portion 32 and two wings, a right wing 34 and a left wing 40. The right wing 34 terminates in a tip 36, and the left wing 40 terminates in a tip 42. The tips 36 and 42 are joined by a concave inner perimeter 46.

On the bottom of the visor, as shown in FIG. 2, there are three fastening elements or patches secured to the visor. There is a fastening element or patch 38 secured to the right wing 34 adjacent to the tip 36. There is also a fastening element or patch 44 secured to the left wing 40 adjacent to the tip 42. A center fastening element or patch 48 is secured to the visor 30 at about the apex of the inner perimeter 46. The center fastening element 48 is accordingly disposed about midway between the right wing fastener element 38 and the left wing fastener element 44.

For convenience, and for the ease of removing or adjusting the visor 30 relative to the helmet 10, the fastener element patches 38, 44, and 48 may preferably be hook type fastener elements, with mating loop type fastener elements appropriately secured to the helmet 10.

There are three fastener portions secured to the helmet, a center or front fastener element patch 14 secured to the front portion 12 adjacent to the bottom rim 24. There is a right side fastener element patch 18 secured to the right side 16 above the rim 24, and a left side fastener element patch, not specifically shown, but generally aligned with the right side fastener element patch 18. The left side patch may be inferred from FIG. 3. The fastener element patches on the sides of the helmet are relatively elongated and extend in a generally upwardly or vertical alignment, best shown and explained in conjunction in FIGS. 4 and 5.

For securing the visor 30 to the helmet 10, the visor is disposed against the helmet 10 with the first mating engagement between the fastener elements taking place in the center of the visor. The center fastening element patch 48 of the visor accordingly is disposed against the center fastening element patch 14, and appropriate engagement is made between the two. The visor is then adjusted by placing the wings 34 and 40 in an appropriate orientation relative to the helmet 10 as desired by the user of the helmet apparatus 10.

As shown in FIG. 4, when the wings are generally secured to the lower bottom portion of the side fastener elements, the visor 30 is in a somewhat horizontal orientation. This would be a typical situation when the sun is not low on the horizon.

In FIG. 5, the visor 30 is tipped relatively sharply downwardly, as when the sun is low on the horizon, with the wings 34 and 40 being elevated relative to the center front portions of the helmet and visor. The fastening elements on the wings 34 and 40 are accordingly secured to the side fastener element patches adjacent to the top of the fastener element patches on the helmet.

The fastener element patch 18 is shown at a slight angular orientation, and may be best understood from FIGS. 4 and 5. This orientation permits the arcuate movement, as it were, of the wings 34 and 40, and accordingly causes the change in the orientation of the visor, as shown in FIGS. 4 and 5. The front fastener patch elements 14 and 48 accordingly become the pivot points or pivot axis for the pivoting of the visor apparatus 30. It will be noted that the use of the hook and loop type fasteners allows a mating engagement of the patch elements 14 and 48 at other than a face to face engagement. This may be understood with reference to FIGS. 4 and 5.

The wings 34 and 40 are moved or pivoted upwardly or downwardly to adjust the visor 30 in a desired orientation. Thus, it will be understood that a bicycle rider may start out with the visor 30 in the orientation illustrated in FIG. 4, with the visor 30 generally flat or horizontal. As the rider heads into a sunset, the visor 30 may be pivoted downwardly, with the wings pivoting upwardly, to keep the setting sun out of the eyes of the bicycle rider/user of the helmet apparatus 10.

While hook and loop type fasteners have been discussed, it is obvious that other types of fastener elements may also be used. However, it would appear that, under contemporary technology, hook and loop type fasteners may be preferred.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Visor apparatus for a bicycle helmet comprising in combination:

visor means, including a center portion and a right wing and a left wing extending outwardly from the center portion;

first fastener means secured to the center portion;

second fastener means secured to the right wing;

third fastener means secured to the left wing;

a helmet having a front portion, a right side portion and a left side portion;

helmet fastener means, including fourth fastener means secured to the front portion of the helmet, fifth fastener means generally vertically elongated and secured to the right side portion of the helmet, and sixth fastener means generally vertically elongated and secured to the left side portion of the helmet, the fourth, fifth, and sixth fastener means for matingly engaging the respective first, second, and third fastener means to secure the visor means to the helmet, the mating engagement of the first and the fourth fastener means defining a pivot point by mating at other than a face to face engagement, and the vertical elongation of the fifth and sixth fastener means comprising a plurality of locations for the mating engagement of the second fastener means and the third fastener means respectively with the elongated fifth and sixth fastener means for pivoting the visor means relative to the helmet.

2. The apparatus of claim 1 in which the fifth and sixth fastener means have slight angular orientations to permit arcuate movement of the right and left wings of the visor means.

3. Adjustable visor apparatus for a bicycle helmet having a front portion, a right side portion, and a left side portion, comprising in combination:

first fastener means to be secured to the helmet, including a front fastener portion comprising a pivot point for the visor apparatus, a generally vertically extending and angularly oriented right side fastener portion, and a generally vertically extending and angularly oriented left side fastener portion;

visor means adjustably securable to the helmet, including a center portion, a right wing portion, and a left wing portion; and second fastener means secured to the visor means, including a center portion the matingly engaging the front fastener portion of the first fastener means at other than a face to face engagement to define a pivot point, a right wing portion for matingly engaging the right side fastener portion of the first fastener means at a plurality of locations for pivoting the center portion of the visor means relative to the helmet, and a left wing portion for matingly engaging the left side fastener portion of the first fastener means at a plurality of locations for pivoting the center portion of the visor means relative to the helmet.

4. The apparatus of claim 3 in which the right and left side fastener portions of the first fastener means have slight angular orientations for permitting arcuate movement of the center portion of the visor means as the right wing portion and the left wing portion of the second fastener means matingly engage the respective right and left side fastener portions of the first fastener means at plurality of locations.

* * * * *